US005812496A

United States Patent [19]

Peck

[11] Patent Number: 5,812,496

[45] Date of Patent: Sep. 22, 1998

[54] WATER RESISTANT MICROPHONE

[75] Inventor: Jerome Peck, Mission Viejo, Calif.

[73] Assignee: Peck/Pelissier Partnership, Costa Mesa, Calif.

[21] Appl. No.: 954,589

[22] Filed: Oct. 20, 1997

[51] Int. Cl.[6] ..... H04R 1/44; H04R 13/00

[52] U.S. Cl. ..... 367/174; 367/168; 367/176

[58] Field of Search ..... 367/141, 174, 367/176, 175, 168, 173; 310/337; 381/168, 189

[56] References Cited

U.S. PATENT DOCUMENTS

| | | | |
|---|---|---|---|
| 2,515,031 | 7/1950 | Black, Jr. | 367/175 |
| 3,562,451 | 2/1971 | Mullen, Jr. et al. | 367/174 |
| 3,764,966 | 10/1973 | Abbagnaro | 367/171 |
| 4,139,742 | 2/1979 | Walker | 381/68 |
| 4,920,564 | 4/1990 | Allkins | 381/189 |
| 5,222,050 | 6/1993 | Marren et al. | 367/163 |

*Primary Examiner*—Ian J. Lobo
*Attorney, Agent, or Firm*—G. Donald Weber, Jr.

[57] ABSTRACT

A microphone for use in underwater applications. The microphone includes a dynamic magnet and coil assembly in a housing which incorporates a hydrophobic membrane. The membrane is sufficiently porous to permit air to pass therethrough. However, water cannot pass through the membrane. The housing permits water to drain away whereby a superior underwater microphone is obtained. This invention provides the diver with a military-style noise canceling microphone that retains exceptional sound reproduction quality because it is not encapsulated. However, the new microphone can be repeatedly exposed to the marine environment without failure.

22 Claims, 1 Drawing Sheet

FIG.3
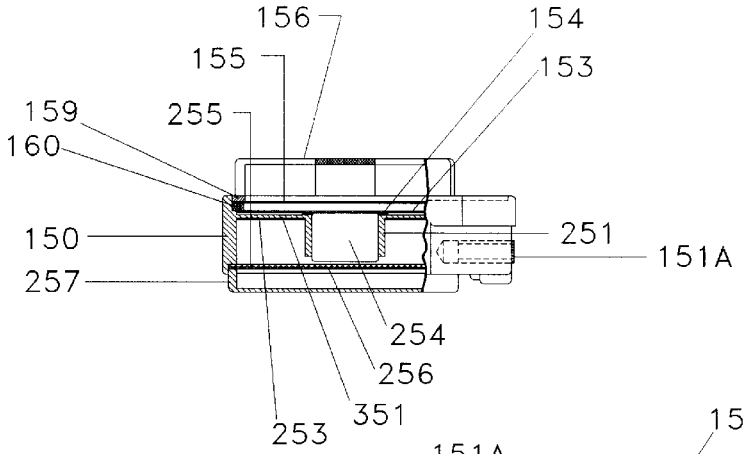
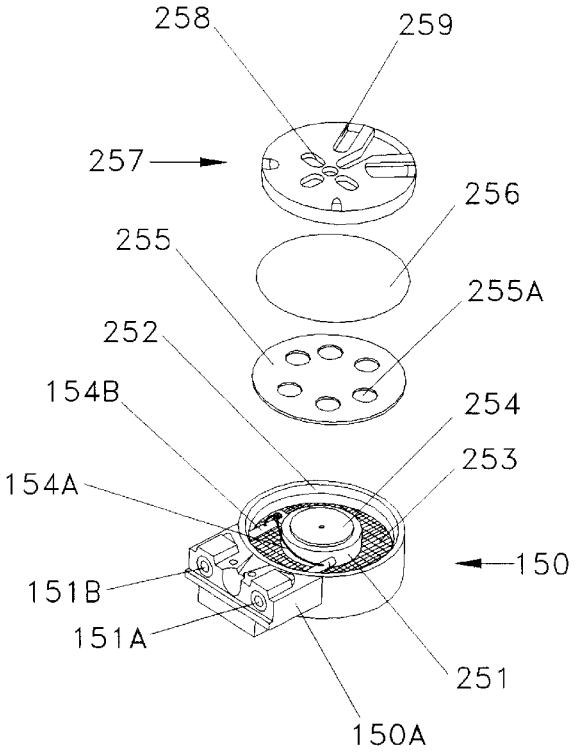
FIG.2
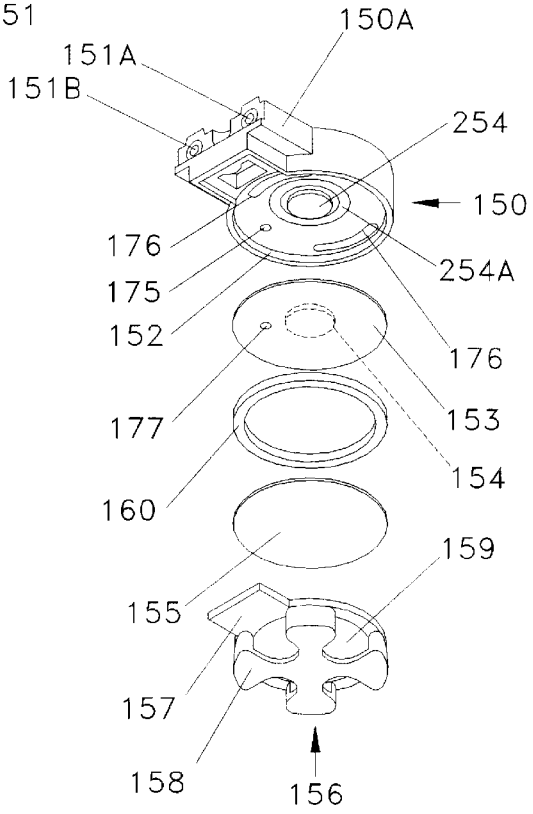
FIG.1

WATER RESISTANT MICROPHONE

BACKGROUND

1. Field of the Invention

This invention is directed to underwater microphones, in general, and to an underwater microphone in a housing which permits water to drain therefrom without damaging the microphone assembly, in particular.

2. Prior Art

In the field of underwater activities, whether for business or pleasure, it is necessary and/or desirable for divers to be able to communicate. The communication can be between two (or more) divers underwater or between a diver and a station or individual at the surface.

Technology has progressed to the point where intelligible communication can be conducted by means of acoustical systems with microphones and earpieces.

There are several noise canceling microphone designs known in the art. Most of these known designs rely on ceramic microphone technology rather than dynamic or magnetic technology. Typically, whan a microphone is contructed for the underwater environment, the design is usually encapsulated within a pair of ceramic plates and a potting compound. However, problems arise when sound passes through the potting compound whereby distortion and limited response result.

Currently, a conventional noise cancelling microphone is installed in a mouth or full face mask of a diver. This arrangement has produced a dramatic increase in the intelligibility of speech by cancelling the bubble noise as well as the acoustic characteristics of the mask. However, the harsh operating environment, i.e. water or sea water, soon renders the microphone inoperable because of water damage.

Other microphones have been designed with pressure compensating bags or suspended rubber diaphragms that cover the front of the speech diaphragm. Both approaches provide a means for pressure compensation without the need to encapsulate the microphone element. The problem lies in the additional diaphragm of interface such as a collapsible bag over the element. This interface causes undesirable frequency response shifts as a result of Helmholtz effect created by the space between the additional pressure compensating bag or diaphragm and the speech diaphragm. Additionally, the frequency response is affected by the diver's depth because the Helmholtz cavity is dimensionally changing as the bag or diaphragm moves.

SUMMARY OF THE INSTANT INVENTION

This invention provides the diver with a military-style noise canceling microphone that retains the expected sound quality because it is not encapsulated. However, the new microphone can be repeatedly exposed to the marine environment without failure.

The invention comprises a microphone which includes a main housing which supports a speech diaphragm, an hydrophobic membrane and a rear cover on one side thereof. The other side of the main housing supports a magnet assembly surrounded by an acoustic damping cloth, with a moisture barrier, a barrier mounting device and a front cover on the other side.

The several components can be fabricated of various materials formed in various shapes and configurations.

BRIEF DESCRIPTION OF THE DRAWINGS

FIG. 1 is an exploded view of the microphone assembly of the instant invention taken from a front perspective.

FIG. 2 is an exploded view of the microphone assembly of the instant invention taken from a rear perspective.

FIG. 3 is a partially broken away side view of the microphone assembly of the instant invention.

DESCRIPTION OF A PREFERRED EMBODIMENT

Referring now to FIG. 1, there is shown an exploded view of the microphone assembly of the instant invention taken from a front perspective.

The front portion 100 of the assembly includes a main housing 150 which is, typically, fabricated of ASB plastic. The housing includes one or more contacts 151, typically mounted in an extended section 150A, which provide electrical connection to a conventional transmitter unit, amplifier or the like (not shown). The rear face of the housing 150 includes a recess 152 for receiving the speech membrane 153 which is, typically formed of a thin sheet of mylar.

Incidentally, the inner surface of recess 152 includes a plurality of apertures therethrough. These apertures include small apertures 175 and the elongated apertures or slots 176. The apertures and slots permit pressure equalization in housing 100 on opposite sides of the inner surface thereof.

In addition, a magnet 254 is mounted snugly in an aperture 180 through the inner surface of the housing 100. The magnet 254 includes an annular groove 254A formed therein.

The diaphragm 153 includes a voice coil 154 which is, typically, formed of a coil of copper wire affixed to the inner surface thereof. Typically, the coil 154 is formed of a thin copper wire which includes suitable insulating coating, for example, enamel or the like. The respective ends of the voice coil 154 are connected to the contacts 151A and 151B. For example, the ends of the coil wire pass through an opening 175 through the housing 150. A suitable insulating adhesive can be used to secure the wires to the housing 150 to avoid fatigue effects.

The voice coil 154 is adapted to interact with the magnet 254 which is centrally mounted on the front surface of housing 150 and within the recess 152. A current is generated in voice coil 154 as a result of motion of the coil 154 relative to the magnet in response to activation of the diaphragm 153, fabricated of mylar, for example, by a user of the microphone.

In a preferred embodiment, the diaphragm 153 is pierced by a tiny pin (or the like) to produce a small aperture 176 therethrough. This aperture permits air to pass therethrough in order to provide pressure equalization of the diaphragm.

A hydrophobic membrane 155 fabricated of polypropylene or similar polymeric material, for example, is mounted within the recess 152 and substantially covers the diaphragm 153. In a preferred embodiment, the membrane has a plurality of holes or pores therethrough. The pores are, typically, about 0.2 micrometers in diameter. The pores are selected to have a diameter which will pass an air molecule but is too small for a water molecule to pass therethrough.

In a preferred embodiment, a diaphragm retaining ring 160 is included between the membrane 155 and the diaphragm 153. The ring 160, fabricated of plastic, for example, is used to provide support for the diaphragm and to space the diaphragm away from the membrane 155.

The rear cover 156 includes a front or inner surface 157 which is shaped to snugly fit into the recess 152 to retain and protect the diaphragm 153 and the membrane 155 in place in the housing 150.

In addition, the front cover 156 includes an outer surface 158 which has any suitable configuration and includes at least one relatively large aperture 159 which permits water to drain from the microphone under the water's own weight. Typically, the inner surface of the front cover is spaced away from the membrane by a relatively large distance, eg. on the order of 0.15 inches.

Referring now to FIG. 2, there is shown an exploded view of the microphone of the instant invention taken from a rear perspective.

The main housing 150 includes the contacts 151 as described supra. The wire ends 154A and 154B from coil 154 pass through the opening 175 as described supra. The coil wire ends 154A and 154B are connected to the contacts 151A and 151B, respectively. A rear recess 252 is provided at the surface of the housing. Typically, the magnet 254 is snugly fitted into an aperture through the back of recess 252. The magnet assembly 254 is mounted to the housing within the recess 252. Except as described supra, the magnet assembly is conventional.

An acoustic damping cloth 253 is mounted in the recess 252 behind the magnet assembly 254. The cloth surrounds (or substantially surrounds) the magnet assembly 254. Typically, the cloth 253 is fabricated of nylon and is about 0.005 inches thick. The acoustic damping cloth has the effect of cancelling acoustic "ringing" which could be caused by the housing material and/or the size of the housing. It has the effect of causing a "selective" acoustic short circuit to certain frequencies.

Moisture barrier mounting disk 255 is formed of any suitable material such as compressed polyethylene fiber. The disk 255 is configured to fit snugly into the recess 252 in housing 150. The disk 255 includes a plurality of apertures 255A therethrough for the purpose of passing sound vibration. These tuned ports are determined by Helmholtz cavity resonance, i.e. acoustic tuning, techniques. That is, disk 255 remains substantially constantly positioned so that the acoustic tuning of the microphone does not vary significantly in operation.

The moisture barrier 256 is, in this embodiment, a disk of mylar or other suitable waterproof material. The barrier also fits snugly into the recess 252 in housing 150 and prevents moisture from passing therethrough or therearound in housing 150. The moisture barrier 256 is supported by the mounting disk 255 in any suitable manner. In some cases, the barrier 256 and the disk 255 may be adhered to each other or even formed as a unitary or integral device.

The rear cover 257 is also disk shaped and fits snugly into the recess 252 in housing 150. Again, the rear cover can be joined to the housing 150 by any suitable means including a threaded engagement.

The rear cover 259 includes a plurality of apertures 258 therethrough for entry of sound waves through to the several disks, membranes, other components mounted within the housing 150 and, finally, the diaphragm 153.

At least one water drain slot 259 is provided in rear cover 257 to permit moisture within the housing 150 to drain away when the microphone assembly is no longer immersed in water. The front and rear covers are, typically, fabricated of a suitable material such as ASB plastic or the like.

When assembled, the several components in each side of the microphone are glued to each other. For example, the diaphragm 153 is glued to the housing 150 in recess 152. In like fashion, the rear cover is glued to membrane 155 which is glued to retaining ring 160, which is glued to diaphragm 153. In the front portion of the microphone, the front cover 257 is glued to moisture barrier 256 which is glued to mounting disk 255, which is glued to housing 150 in recess 252. Of course, all of the gluing steps can be accomplished individually or together.

Referring now to FIG. 3, there is shown a partially broken away, cross-sectional view of the microphone assembly of the instant invention. Thus, the housing 150 includes the central support 351 which is molded or otherwise formed in the housing 150. The diaphragm 153, retaining ring 160, membrane 155 and rear cover 156 are shown arranged adjacent to each other and stacked within recess 152. The rear cover 156 is affixed to the housing 150 to retain the components in place.

The magnet assembly 254, damping cloth 253, barrier disk 256 and mounting disk 255 and the front cover 257 are shown arranged adjacent to each other and stacked within recess 252. The front cover 257 is affixed to housing 150 to retain the components in place.

Thus, there is shown and described a unique design and concept of water resistant microphone. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A microphone assembly for underwater applications comprising, a housing, a magnet assembly mounted in said housing, acoustic damping means mounted in said housing adjacent to one side of said magnet assembly, a moisture barrier mounted in said housing adjacent to said acoustic damping means, first cover means with drain slots therethrough adapted to be coupled to said one side of said housing, a speech diaphragm mounted in said housing adjacent to the opposite side of said magnetic assembly, a hydrophobic membrane mounted in said housing adjacent to said speech diaphragm, and second cover means adapted to be coupled to the opposite side of said housing with apertures therethrough to permit acoustic pressure to be applied to said speech diaphragm.

2. The assembly recited in claim 1 including, ring means interposed between said hydrophobic membrane and said speech diaphragm for supporting said speech diaphragm.

3. The assembly recited in claim 1 wherein, said speech diaphragm includes a small aperture therethrough to permit pressure equalization at said speech diaphragm within said housing.

4. The assembly recited in claim 1 including, a mounting disk for supporting said moisture barrier.

5. The assembly recited in claim 4 wherein, said mounting disk includes a plurality of apertures therethrough to pass sound vibration.

6. The assembly recited in claim 1 wherein, said magnetic assembly includes a generally cylindrical magnet with an annular groove therein around the axis thereof.

7. The assembly recited in claim 6 including, coil means mounted on said speech diaphragm and adapted to be movably disposed within said annular groove in said magnet.

8. The assembly recited in claim 7 including, at least one electrically conductive contact mounted on said housing and connected to said coil means.

9. The assembly recited in claim 1 including, at least one aperture through said housing to permit pressure equalization within said housing.

10. The assembly recited in claim 1 wherein, said housing includes a first recess in said one side for receiving said acoustic damping means and said moisture barrier.

11. The assembly recited in claim 1 wherein, said housing includes a second recess in said opposite side for receiving said speech diaphragm and said hydrophobic membrane.

12. The assembly recited in claim 1 wherein, said housing includes a first recess in said one side for receiving said acoustic damping means and said moisture barrier, and said housing includes a second recess in said opposite side for receiving said speech diaphragm and said hydrophobic membrane.

13. The assembly recited in claim 1 including, at least one aperture passing through said housing in order to permit pressure equalization on both sides thereof.

14. The assembly recited in claim 7 wherein, said coil means comprises a coil of copper wire.

15. The assembly recited in claim 1 wherein, said hydrophobic membrane includes at least one aperture therethrough which will pass air therethrough but prevent the passage of water therethrough.

16. The assembly recited in claim 1 wherein, said first cover means and said drain slots permit water to readily drain away from said assembly.

17. The assembly recited in claim 8 wherein, said coil means is connected to said contact by the ends of said coil means passing through said housing.

18. The assembly recited in claim 1 wherein, said acoustic damping means cancels acoustic ringing caused by said housing.

19. The assembly recited in claim 4 wherein, said apertures are defined by Helmholtz acoustic tuning techniques such that the acoustic tuning of said assembly does not vary significantly during operation.

20. The assembly recited in claim 5 wherein, said mounting disk and said moisture barrier are separate components.

21. The assembly recited in claim 12 wherein, said housing includes a central support intermediate said first and second recesses.

22. A microphone assembly for underwater applications comprising, a housing, a magnet assembly mounted in said housing, said magnetic assembly includes a generally cylindrical magnet with an annular groove therein around the axis thereof, an acoustic damping device mounted in said housing adjacent to one side of said magnet assembly, a moisture barrier mounted in said housing adjacent to said acoustic damping means, a mounting disk for supporting said moisture barrier, first cover means with drain slots therethrough adapted to be coupled to said one side of said housing, a speech diaphragm mounted in said housing adjacent to the opposite side of said magnetic assembly, a hydrophobic membrane mounted in said housing adjacent to said speech diaphragm, a support ring interposed between said hydrophobic membrane and said speech diaphragm for supporting said speech diaphragm, and second cover means adapted to be coupled to the opposite side of said housing with apertures therethrough to permit acoustic pressure to be applied to said speech diaphragm.

* * * * *